US012168810B2

(12) United States Patent
Cho et al.

(10) Patent No.: US 12,168,810 B2
(45) Date of Patent: Dec. 17, 2024

(54) HIGH-STRENGTH COLD-ROLLED STEEL SHEET HAVING EXCELLENT BENDING WORKABILITY AND MANUFACTURING METHOD THEREFOR

(71) Applicant: POSCO, Pohang-si (KR)

(72) Inventors: Hang-Sik Cho, Gwangyang-si (KR); Young-Roc Im, Gwangyang-si (KR)

(73) Assignee: POSCO CO., LTD, Pohang-si (KR)

( * ) Notice: Subject to any disclaimer, the term of this patent is extended or adjusted under 35 U.S.C. 154(b) by 665 days.

(21) Appl. No.: 17/413,259

(22) PCT Filed: Dec. 19, 2019

(86) PCT No.: PCT/KR2019/018106
§ 371 (c)(1),
(2) Date: Jun. 11, 2021

(87) PCT Pub. No.: WO2020/130675
PCT Pub. Date: Jun. 25, 2020

(65) Prior Publication Data

US 2022/0042133 A1 Feb. 10, 2022

(30) Foreign Application Priority Data

Dec. 19, 2018 (KR) ..... 10-2018-0165144

(51) Int. Cl.
*C21D 9/46* (2006.01)
*C21D 8/02* (2006.01)
(Continued)

(52) U.S. Cl.
CPC ..... *C21D 9/46* (2013.01); *C21D 8/0236* (2013.01); *C21D 8/0247* (2013.01);
(Continued)

(58) Field of Classification Search
None
See application file for complete search history.

(56) References Cited

U.S. PATENT DOCUMENTS 9,410,231 B2 8/2016 Okamoto et al.
2012/0305144 A1 12/2012 Okamoto et al.
(Continued)

FOREIGN PATENT DOCUMENTS

CN 107109582 8/2017
CN 108431268 8/2018
(Continued)

OTHER PUBLICATIONS

International Search Report—PCT/KR2019/018106 dated Apr. 2, 2020.
(Continued)

*Primary Examiner* — Anthony M Liang
(74) *Attorney, Agent, or Firm* — CANTOR COLBURN LLP

(57) ABSTRACT

A high-strength cold-rolled steel sheet having excellent bending workability includes, by weight %, 0.13-0.25% of carbon (C), 1.0-2.0% of silicon (Si), 1.5-3.0% of manganese (Mn), 0.08-1.5% of aluminum (Al)+chromium (Cr)+molybdenum (Mo), 0.1% or less of phosphorus (P), 0.01% or less of sulfur (S), 0.01% or less of nitrogen (N), the remainder of Fe and inevitable impurities, and comprises, by area fraction, 3-25% of ferrite, 20-40% of martensite, and 5-20% of retained austenite, in which a nickel-rich layer formed of nickel (Ni) introduced from the outside is provided on a surface layer portion, and the concentration of nickel (Ni) at a depth of 1 μm from the surface may be greater than or equal to 0.15 wt %.

13 Claims, 4 Drawing Sheets

(51) Int. Cl.

| | |
|---|---|
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/22*** | (2006.01) |
| ***C22C 38/28*** | (2006.01) |
| ***C22C 38/32*** | (2006.01) |
| ***C23C 2/04*** | (2006.01) |
| ***C23C 2/40*** | (2006.01) |

(52) U.S. Cl.

CPC ..... *C22C 38/001* (2013.01); *C22C 38/002* (2013.01); *C22C 38/02* (2013.01); *C22C 38/04* (2013.01); *C22C 38/06* (2013.01); *C22C 38/22* (2013.01); *C22C 38/28* (2013.01); *C22C 38/32* (2013.01); *C23C 2/04* (2013.01); *C23C 2/40* (2013.01); *C21D 2211/001* (2013.01); *C21D 2211/002* (2013.01); *C21D 2211/005* (2013.01); *C21D 2211/008* (2013.01)

(56) References Cited

U.S. PATENT DOCUMENTS

| | | | | |
|---|---|---|---|---|
| 2014/0170439 | A1 | 6/2014 | Allain et al. | |
| 2015/0059935 | A1 | 3/2015 | Hebesberger et al. | |
| 2015/0075680 | A1* | 3/2015 | Tanaka ..... | C21D 1/26 148/333 |
| 2017/0101695 | A1 | 4/2017 | Arlazarov et al. | |
| 2017/0137907 | A1 | 5/2017 | Mohanty et al. | |
| 2018/0002790 | A1 | 1/2018 | Kim et al. | |
| 2018/0371569 | A1 | 12/2018 | Kwak et al. | |
| 2018/0371570 | A1 | 12/2018 | Kim et al. | |
| 2019/0040482 | A1 | 2/2019 | Kimata et al. | |

FOREIGN PATENT DOCUMENTS

| | | | |
|---|---|---|---|
| CN | 108431273 | | 8/2018 |
| EP | 2530180 | | 12/2012 |
| EP | 2837707 | | 2/2015 |
| EP | 3164518 | | 5/2017 |
| JP | 2002047535 | | 2/2002 |
| JP | 2002241896 | | 8/2002 |
| JP | 2010275627 | | 12/2010 |
| JP | 2014019905 | | 2/2014 |
| JP | 2014173138 | | 9/2014 |
| JP | 2014173138 | A * | 9/2014 |
| KR | 20140012167 | | 1/2014 |
| KR | 101477877 | | 12/2014 |
| KR | 20140143426 | | 12/2014 |
| KR | 20160080818 | | 7/2016 |
| KR | 20170002652 | | 1/2017 |
| KR | 101736632 | | 5/2017 |
| KR | 101736634 | | 5/2017 |
| KR | 101736635 | | 5/2017 |
| KR | 20180099867 | | 9/2018 |
| WO | 2015015239 | | 2/2015 |
| WO | 2016001706 | | 1/2016 |

OTHER PUBLICATIONS

European Search Report—European Application No. 19899567.2 issued on Oct. 18, 2021, citing EP 2837707, KR 10-1736634, and EP 3164518.

Chinese Office Action—Chinese Application No. 201980081720.6 issued on Jun. 27, 2022, citing KR 10-1736632, JP 2014-173138, CN 108431268, CN 108431273, CN 107109582, KR 10-1736635, BR 112016030065, JP 2002-047535, and BR 112012018697.

Japanese Office Action—Japanese Application No. 2021-534950 issued on Sep. 13, 2022, citing JP 2014-173138, KR 10-1736632, JP 2002-047535, and JP 2002-241896.

* cited by examiner

HIGH-STRENGTH COLD-ROLLED STEEL SHEET HAVING EXCELLENT BENDING WORKABILITY AND MANUFACTURING METHOD THEREFOR

TECHNICAL FIELD

The present disclosure relates to a cold-rolled steel sheet and a method of manufacturing the same, and more particularly, to a cold-rolled steel sheet having high-strength properties and having effectively improved bending workability, and a method of manufacturing the same.

BACKGROUND ART

Steel sheets for vehicles have increasingly employed a high-strength steel material to assure fuel economy regulations for preserving the global environment and the safety of passengers in accidents. The grade of steel for vehicles may usually be represented by a product of tensile strength and an elongation rate (TS×EL), and as representative examples, there may be advanced high strength steel (AHSS) with TS×EL less than 25,000 MPa·%, ultra high strength steel (UHSS) exceeding 50,000 MPa·%, and extra-advanced high strength steel (X-AHSS) having a value between AHSS and UHSS, although not necessarily limited thereto.

Once a grade of steel is determined, since a product of tensile strength and an elongation rate is determined to be almost constant, it may not be easy to simultaneously satisfy tensile strength and an elongation rate of a steel material because a general steel material may have properties in which tensile strength and an elongation rate of a steel material may be inversely proportional to each other.

To increase a product of strength and an elongation rate of a steel material, as a steel material with a new concept, a steel material using transformation induced plasticity (TRIP) phenomenon, which may improve both workability and strength due to retained austenite present in the steel material, has been developed, and such TRIP steel may have an improved elongation rate even at the same strength such that the steel has been mainly used to manufacture a high-strength steel material having high formability.

However, even when such a general steel material may secure a high level of tensile strength or an elongation rate, there may be a problem in that bending workability may be weak, which may be problematic.

Since a TRIP cold-rolled steel sheet, generally used as a steel sheet for vehicles, may be manufactured through an annealing heat treatment process at a high temperature after cold rolling, a decarburization reaction on the surface of the steel sheet may be induced during annealing. In other words, as carbon, an austenite stabilizing element, disappears from the surface of the steel sheet, it may not be possible to sufficiently secure retained austenite which may be advantageous for securing an elongation rate on the surface side of the steel sheet. Therefore, when a severe bending process is performed on such a steel sheet, cracks may be easily created and propagated in the surface layer of the steel sheet, which may cause fracturing of the steel sheet. During the process of bending the steel sheet, one side of the steel sheet may contract while the other side of the steel sheet opposing thereto may be stretched. Accordingly, in the case of a steel sheet in which retained austenite is not sufficiently secured in the surface layer, it may be highly likely that cracks may be created from the surface layer of the steel sheet on the stretched side.

Therefore, even when the annealing heat treatment process is performed, it may be necessary to develop a cold-rolled steel sheet which may effectively secure a retained austenite fraction of the surface layer to effectively prevent cracks in the bending process, and a method of manufacturing the same.

PRIOR ART DOCUMENT (Reference 1) Japanese Laid-Open Patent Publication No. 2014-019905 (publicized on Feb. 3, 2014)

DISCLOSURE

Technical Problem

An aspect of the present disclosure is to provide a high-strength cold-rolled steel sheet having excellent bending workability and a method of manufacturing the same.

The purpose of the present disclosure is not limited to the above description. A person skill in the art would have no difficulty in understanding additional purpose of the present disclosure from overall description in the present specification.

Technical Solution

A high-strength cold-rolled steel sheet having excellent bending workability according to an aspect of the present disclosure includes, by weight %, 0.13-0.25% of carbon (C), 1.0-2.0% of silicon (Si), 1.5-3.0% of manganese (Mn), 0.08-1.5% of aluminum (Al)+chromium (Cr)+molybdenum (Mo), 0.1% or less of phosphorus (P), 0.01% or less of sulfur (S), 0.01% or less of nitrogen (N), and a balance of Fe and inevitable impurities; by area fraction, 3-25% of ferrite, 20-40% of martensite, and 5-20% of retained austenite; and a nickel concentration layer, formed by nickel (Ni) introduced from the outside, on a surface layer, wherein a concentration of nickel (Ni) at a depth of 1 μm from a surface is 0.15 wt % or more.

A critical curvature ratio (Rc/t) of the cold-rolled steel sheet may be 2 or less.

Here, the critical curvature ratio (Rc/t) may be measured by a cold bending test in which a steel sheet is bent by 90° using a plurality of cold bending jigs having tips of various radiuses of curvature (R), and t and Rc refer to a thickness of the steel sheet provided to the cold bending test and a radius of curvature of a tip of the cold bending jig at the time at which cracks are created in the surface layer of the steel sheet, respectively.

The cold-rolled steel sheet may further include 15 to 50% of bainite by area fraction.

A fraction of retained austenite on the surface of the cold-rolled steel sheet may be 5 to 20 area %.

Based on t/4 (where t refers to a thickness of the steel sheet), an average grain size of ferrite may be 2 μm or less, and an average value of a ratio of a length of ferrite of the cold-rolled steel sheet in a rolling direction to a length of ferrite of the cold-rolled steel sheet in a thickness direction may be 0.5-1.5.

The cold-rolled steel sheet may include 3-15 area % of ferrite.

Martensite may include tempered martensite and fresh martensite, and a ratio of tempered martensite in martensite may exceed 50 area %.

The cold-rolled steel sheet may further include, by weight %, one or more of 0.001-0.005% of boron (B) and 0.005-0.04% of titanium (Ti).

Aluminum (Al) may be included in the cold-rolled steel sheet in an amount of 0.01-0.09 weight %.

Chromium (Cr) may be included in the cold-rolled steel sheet in an amount of 0.01-0.7 weight %.

Chromium (Cr) may be included in the cold-rolled steel sheet in an amount of 0.2-0.6 weight %.

Molybdenum (Mo) may be included in the cold-rolled steel sheet in an amount of 0.02-0.08 weight %.

The cold-rolled steel sheet may further include an alloyed hot-dip galvanized layer formed on the surface thereof.

The cold-rolled steel sheet may have tensile strength of 1180 MPa or more and an elongation rate of 14% or more.

A high-strength cold-rolled steel sheet having excellent bending workability according to an aspect of the present disclosure may be manufactured by cold-rolling a steel material including, by weight %, 0.13-0.25% of carbon (C), 1.0-2.0% of silicon (Si), 1.5-3.0% of manganese (Mn), 0.08-1.5% of aluminum (Al)+chromium (Cr)+molybdenum (Mo), 0.1% or less of phosphorus (P), 0.01% or less of sulfur (S), 0.01% or less of nitrogen (N), and a balance of Fe and inevitable impurities, and applying nickel (Ni) powder on a surface of the cold-rolled steel material in a coating amount of 300 mg/m$^2$, heating the steel material to completely transform the steel material to austenite, slowly cooling the heated steel material at a cooling rate of 5-12° C./s to a slow cooling termination temperature of 630-670° C., and maintaining the steel material at the slow cooling termination temperature for 10-90 seconds, rapidly cooling the slowly cooled and maintained steel material at a cooling rate of 7-30° C./s to a temperature range of a martensitic transformation termination temperature (Mf) or higher and a martensitic transformation initiation temperature (Ms) or lower, and maintaining the rapidly cooled steel material at a temperature higher than the martensitic transformation initiation temperature (Ms) and the bainite transformation initiation temperature (Bs) or lower for 300-600 seconds and partitioning the steel material.

The steel material may further include, by weight %, one or more of 0.001-0.005% of boron (B) and 0.005-0.04% of titanium (Ti).

Aluminum (Al) may be included in the steel material in an amount of 0.01-0.09 weight %.

Chromium (Cr) may be included in the steel material in an amount of 0.01-0.7 weight %.

Chromium (Cr) may be included in the steel material in an amount of 0.2-0.6 weight %.

Molybdenum (Mo) may be included in the steel material in an amount of 0.02-0.08 weight %.

An alloyed hot-dip galvanized layer may be formed on the surface of the cold-rolled steel sheet.

The means for solving the above problems do not list all the features of the present disclosure, and various features of the present disclosure and advantages and effects thereof will be understood in greater detail with reference to the specific embodiments below.

Advantageous Effects

According to an aspect of the present disclosure, a cold-rolled steel sheet which may have high strength properties and an excellent elongation rate properties and bending workability and may thus be particularly suitable for a steel sheet for vehicles, and a method of manufacturing the same may be provided.

BEST MODE FOR INVENTION

Figure 1:
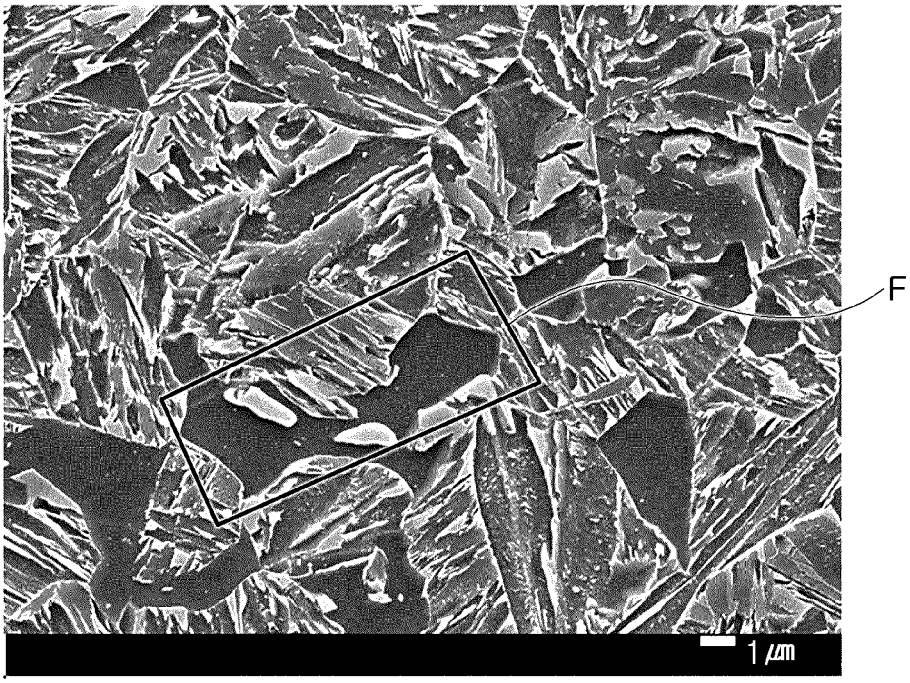
FIG. 1 is an image of a microstructure of a general TRIP steel observed using a scanning electron microscope.

The present disclosure relates to a high-strength cold-rolled steel sheet having excellent bending workability and a method of manufacturing the same, and hereinafter, preferable embodiments of the present disclosure will be described. Embodiments of the present disclosure may be modified in various forms, and the scope of the present disclosure should not be construed as being limited to the embodiments described below. The embodiments are provided to further describe the present disclosure to a person skilled in the art to which the present disclosure pertains.

In the present disclosure, it is necessary to note that a cold-rolled steel sheet may include a conventional unplated cold-rolled steel sheet as well as plated steel sheets. The plating used for the cold-rolled steel sheet in the present disclosure may be all types of plating such as zinc-based plating, aluminum-based plating, alloy plating, and alloying plating, and may be alloyed hot-dip zinc plating preferably.

Hereinafter, a steel composition in the present disclosure will be described in greater detail. Hereinafter, "%" indicating a content of each element may be based on weight unless otherwise indicated.

The cold-rolled steel sheet according to an aspect of the present disclosure may include, by weight %, 0.13-0.25% of carbon (C), 1.0-2.0% of silicon (Si), 1.5-3.0% of manganese (Mn), 0.08-1.5% of aluminum (Al)+chromium (Cr)+molybdenum (Mo), 0.1% or less of phosphorus (P), 0.01% or less of sulfur (S), 0.01% or less of nitrogen (N), and a balance of Fe and inevitable impurities. Also, the cold-rolled steel sheet according to an aspect of the present disclosure may include, by weight %, one or more of 0.001-0.005% of boron (B) and 0.005-0.04% of titanium (Ti). Aluminum (Al), chromium (Cr), and molybdenum (Mo) may be included in an amount of 0.01-0.09%, 0.01-0.7%, and 0.02-0.08%, respectively, by weight %.

Carbon (C): 0.13-0.25%

Carbon (C) may be an important element as carbon (C) may economically secure strength, and thus, in the present disclosure, a lower limit of the carbon (C) content may be limited to 0.13% to obtain the above effect. When carbon (C) is excessively added, weldability may be deteriorated, and thus, an upper limit of the carbon (C) content may be limited to 0.25%. Therefore, the carbon (C) content in the present disclosure may be in the range of 0.15-0.25%. A preferable carbon (C) content may be in the range of 0.14-0.25%, and a more preferable carbon (C) content may be in the range of 0.14-0.20%.

Silicon (Si): 1.0-2.0%

Since silicon (Si) may effectively improve strength and an elongation rate of a steel material, in the present disclosure, the silicon (Si) content may be limited to 1.0% to obtain the above effect. Silicon (Si) may cause surface scale defects, may also degrade surface properties of a plated steel sheet, and may deteriorate chemical conversion treatment properties. Accordingly, the content of silicon (Si) may be generally limited to the range of 1.0% or less, but due to the development of plating technique, the steel sheet may be manufactured with the content of about 2.0% in steel without any significant problem. Thus, the silicon (Si) content in the present disclosure may be in the range of 1.0-2.0%. A preferable silicon (Si) content may be in the range of 1.2-2.0%, and a more preferable silicon (Si) content may be in the range of 1.2-1.8%.

Manganese (Mn): 1.5-3.0%

Manganese (Mn) may significantly contribute to solid solution strengthening when manganese (Mn) is present in steel, and manganese (Mn) may contribute to improving hardenability in transformation-strengthening steel, and thus, in the present disclosure, a lower limit of the manganese (Mn) content may be limited to 1.5%. When manganese (Mn) is excessively added, there may be problems in weldability and cold rolling load, and surface defects such as dents may occur by the formation of annealing concentration product. Thus, an upper limit of the manganese (Mn) content may be limited to 3.0%. Therefore, the manganese (Mn) content in the present disclosure may be in the range of 1.5-3.0%. A preferable manganese (Mn) content may be in the range of 2.0-3.0%, and a more preferable banggan (Mn) content may be in the range of 2.2-2.9%.

Sum of Aluminum (Al), Chromium (Cr) and Molybdenum (Mo): 0.08-1.5%

Since aluminum (Al), chromium (Cr) and molybdenum (Mo) may increase strength and may expand ferrite region, and may be useful for securing a ferrite fraction. In the present disclosure, a sum of aluminum (Al), chromium (Cr) and molybdenum (Mo) contents may be limited to 0.08% or more. When aluminum (Al), chromium (Cr), and molybdenum (Mo) are excessively added, surface quality of the slab may degrade and manufacturing costs may increase, and thus, in the present disclosure, the sum of aluminum (Al), chromium (Cr) and molybdenum (Mo) contents may be limited to 1.5% or less. Accordingly, the sum of aluminum (Al), chromium (Cr) and molybdenum (Mo) contents in the present disclosure may be in the range of 0.08-1.5%.

Aluminum (Al): 0.01-0.09%

Aluminum (Al) may cause deoxidation by being combined with oxygen (O) in steel, and may distribute carbon (C) in ferrite to austenite similarly to silicon (Si), such that martensite hardenability may improve. In the present disclosure, a lower limit of the aluminum (Al) content may be limited to 0.01% to obtain the above effect. When aluminum (Al) is excessively added, nozzle may be clogged during continuous casting, and a decrease in burring properties caused by an increase in strength may be problematic. Therefore, the aluminum (Al) content in the present disclosure may be limited to the range of 0.01-0.09%. A preferable aluminum (Al) content may be in the range of 0.02-0.09%, and a more preferable aluminum (Al) content may be in the range of 0.02-0.08%. In the present disclosure, aluminum (Al) refers to acid-soluble Al (sol.Al).

Chrome (Cr): 0.01-0.7%

Since chromium (Cr) may be an effective hardenability enhancing element, in the present disclosure, a lower limit of the chromium (Cr) content may be limited to 0.01% to obtain the effect of improving strength. When chromium (Cr) is excessively added, the oxidation of silicon (Si) may be facilitated such that red-scale defects on the surface of a hot-rolled material may increase and surface quality of a final steel material may degrade. Thus, in the present disclosure, an upper limit of the chromium (Cr) content may be limited to 0.7%. Therefore, the chromium (Cr) content in the present disclosure may be in the range of 0.01-0.7%. A preferable chromium (Cr) content may be in the range of 0.1-0.7%, and a more preferable chromium (Cr) content may be in the range of 0.2-0.6%.

Molybdenum (Mo): 0.02-0.08%

Since molybdenum (Mo) may also effectively contribute to improvement of hardenability, in the present disclosure, a lower limit of the molybdenum (Mo) content may be limited to 0.02% to obtain the effect of improving strength. However, since molybdenum (Mo) is an expensive element, excessive addition thereof may not be preferable in terms of economic efficiency, and when molybdenum (Mo) is excessively added, strength may excessively increase such that burring properties may be deteriorated. Thus, in the present disclosure, an upper limit of the molybdenum (Mo) content may be limited to 0.08%. A preferable molybdenum (Mo) content may be in the range of 0.03-0.08%, and a more preferable molybdenum (Mo) content may be in the range of 0.03-0.07%.

Phosphorus (P): 0.1% or Less

Phosphorus (P) may be advantageous for securing strength without deteriorating formability of steel, and when phosphorus (P) is excessively added, the possibility of brittle fracture may greatly increase, such that the likelihood of sheet fracture of a slab during hot rolling may increase, and phosphorus (P) may also degrade surface properties. Accordingly, in the present disclosure, an upper limit of the phosphorus (P) content may be limited to 0.1%, and a more preferable upper limit of the phosphorus (P) content may be 0.05%. However, 0% may be excluded in consideration of the inevitably added level.

Sulfur (S): 0.01% or Less

Since sulfur (S) may be inevitably added as an impurity element in steel, it is preferable to manage the content thereof as low as possible. In particular, sulfur (S) may degrade ductility and weldability of steel, and in the present disclosure, it may be preferable to inhibit the content as much as possible. Accordingly, in the present disclosure, an upper limit of the sulfur (S) content may be limited to 0.01%, and a more preferable upper limit of the sulfur (S) content may be 0.005%. However, 0% may be excluded in consideration of the inevitably added level.

Nitrogen (N): 0.01% or Less

Nitrogen (N) may be inevitably added as an impurity element. It may be important to manage nitrogen (N) as low as possible, but to this end, there may be a problem in that costs of refining steel may increase greatly. Accordingly, in the present disclosure, an upper limit of the nitrogen (N) content may be controlled to be 0.01% in consideration of a possible range under operating conditions, and a more preferable upper limit of the nitrogen (N) content may be 0.005%. However, 0% may be excluded in consideration of the inevitably added level.

Boron (B): 0.001-0.005%

Boron (B) may effectively contribute to improvement of strength by solid solution, and may be an effective element such that the above effect may be obtained even by adding a small amount of boron (B). Therefore, in the present disclosure, a lower limit of the boron (B) content may be to 0.001% to obtain the above effect. When boron (B) is added excessively, the strength enhancing effect may be saturated, whereas an excessive boron (B) concentration layer may be formed on the surface such that plating adhesion may be deteriorated. Thus, in the present disclosure, an upper limit of the boron (B) content may be limited to 0.005%. Therefore, the boron (B) content in the present disclosure may be in the range of 0.001-0.005%. A preferable boron (B) content may be in the range of 0.001-0.004%, and a more preferable boron content may be in the range of 0.0013-0.0035%.

Titanium (Ti): 0.005-0.04%

Titanium (Ti) may be effective in increasing strength of steel and refining a particle size. Also, since titanium (Ti) may form TiN precipitates by being combined with nitrogen (N), titanium (Ti) may effectively prevent the loss of the effect of adding boron (B) caused by boron (B) combined with nitrogen (N). Accordingly, in the present disclosure, a lower limit of the titanium (Ti) content may be limited to 0.005%. When the titanium (Ti) is excessively added, a nozzle may be clogged during continuous casting, or ductility of steel may be deteriorated due to excessive formation of precipitates, and thus, in the present disclosure, an upper limit of the titanium (Ti) content may be limited to 0.04%. Therefore, the titanium (Ti) content in the present disclosure may be in the range of 0.005-0.04%. A preferable titanium (Ti) content may be in the range of 0.01-0.04%, and a more preferable titanium (Ti) content may be in the range of 0.01-0.03%.

The cold-rolled steel sheet in the present disclosure may further include a remainder of Fe and inevitable impurities in addition to the steel components described above. Inevitable impurities may be inevitably added from in a general steel manufacturing process, and thus, impurities may not be excluded. A person skilled in the art of a general manufacturing process may be aware of the impurities. Also, addition of effective elements other than the above composition may not be excluded.

Hereinafter, a microstructure in the present disclosure will be described in greater detail. Hereinafter, "%" representing a ratio of a microstructure may be based on an area unless otherwise indicated.

The inventors of the present disclosure reviewed the conditions for securing strength and an elongation rate of a steel material and also having both bending workability, and as a result of the reviewing, even by appropriately controlling strength and an elongation rate in an appropriate range by controlling a composition of a steel material, and a type and fraction of structure, when the surface layer structure of the steel material is not properly controlled, high bending workability may not be obtained, and the present disclosure was suggested.

To secure strength and an elongation rate of the steel material, in the present disclosure, a composition of ferrite in the steel material may be controlled within an appropriate range, and in addition to this, an object of the present disclosure may be a TRIP steel material including retained austenite and martensite.

Generally, in TRIP steel, martensite may be included in a predetermined range in the steel to secure high strength, and ferrite may be included in a predetermined range to secure an elongation rate of the steel. Retained austenite may be transformed into martensite during a processing process, and through this transformation process, retained austenite may contribute to improvement of workability of the steel material.

In this aspect, ferrite in the present disclosure may be included in the range of 3-25% by area fraction. In other words, to provide sufficient an elongation rate, it may be necessary to control the ferrite fraction to be 3 area % or more, and to prevent degradation of strength of the steel material due to excessive formation of ferrite, which may be a soft structure, the ferrite fraction may be controlled to be 25 area % or less. A preferable ferrite fraction may be 20 area % or less, and a more preferable ferrite fraction may be 15 area % or less, or less than 15 area %.

Also, to secure sufficient strength, martensite may be preferably included in a ratio of 20 area % or more, and since an elongation rate may decrease as martensite, a hard structure, is excessively formed, a ratio of martensite may be controlled to be 40 area % or less.

The martensite in the present disclosure may include tempered martensite and fresh martensite, and a ratio of the tempered martensite in total martensite may exceed 50 area %. A preferable ratio of tempered martensite may be 60 area % or more based on total martensite. Fresh martensite may be effective for securing strength, but tempered martensite may be more preferable in terms of securing both strength and an elongation rate.

Also, when retained austenite is included, a TS×EL of the steel material may increase, such that overall balance between strength and an elongation rate may improve. Therefore, it may be preferable to include retained austenite by 5 area % or more. W When retained austenite is excessively formed, there may be a problem in that sensitivity of hydrogen embrittlement may increase, and thus, it may be preferable to control a fraction of retained austenite to be 20 area % or less.

In addition to this, in the present disclosure, 15-50% of bainite may further be included by area fraction. Since bainite may improve workability by reducing a difference in strength between structures, it may be preferable to control the bainite fraction to be 15 area % or more. When the bainite is excessively formed, workability may be degraded. Therefore, a fraction of bainite may be preferably controlled to be 45 area % or less.

In the steel material in the present disclosure, since martensite, a hard structure, and ferrite, a soft structure, may be included, such that, during a burring process or a press process similar thereto, cracks may be initiated and propagated in a boundary between the soft structure and the hard structure. The ferrite structure may greatly contribute to improvement of an elongation rate, but may cause cracks due to a difference in hardness between the ferrite and martensite structures in a burring process.

To prevent such damages, according to an aspect of the present disclosure, ferrite may be micronized and also a ratio (a length of the steel sheet in the rolling direction/a length of the steel sheet in the thickness direction) of a length of ferrite may be limited to a certain range. The inventor of the present disclosure studied in depth the shape of ferrite present in TRIP steel and characteristics of generation and propagation of cracks during processing, and it has been found that a ratio of a length of ferrite (a length of the steel sheet in the rolling direction/a length of the steel sheet in the thickness direction) as well as a grain size of ferrite may affect characteristics of generation and propagation of cracks during processing.

In other words, since ferrite, which is a soft structure, may be present in an elongated form in a rolling direction in general TRIP steel, such that, even by micronization of ferrite grains, it may not be possible to effectively prevent cracks formed in processing from creating in the rolling direction. Accordingly, in the present disclosure, generation and propagation of cracks may be prevented by micronizing ferrite in a final steel material, and by controlling the shape of ferrite.

According to one preferable aspect of the present disclosure, ferrite may be micronized by controlling an average grain size of ferrite to be 2 μm or less, and also, a ratio (a length of the steel sheet in the rolling direction/a length of the steel sheet in the thickness direction) of an average length of ferrite may be controlled to be 1.5 or less. In other words, in the present disclosure, grains of ferrite may be micronized to a certain level or less, and a ratio (a length of the steel sheet in the rolling direction/a length of the steel sheet in the thickness direction) of an average length of ferrite grain may be controlled to be less than a certain level, such that generation and propagation of cracks may be effectively prevented and workability of the steel material may be secured effectively. However, since there is a limitation on the process in controlling a ratio (length in the rolling direction of the steel sheet/length in the thickness direction of the steel sheet) of an average length of ferrite grain to be less than a certain level, in the present disclosure, a lower limit of a ratio (length in the rolling direction of the steel sheet/length in the thickness direction of the steel sheet) of an average length of ferrite grain may be limited to 0.5.

The average grain size of ferrite and the ratio of an average length of ferrite in the present disclosure may be based on the point t/4, where t refers to a thickness (mm) of the steel sheet.

In the present disclosure, since the ferrite may be micronized and the ratio of a length of ferrite may be controlled to an optimum level, generation and propagation of cracks may be effectively prevented in processing the steel material, and accordingly, fracture of the steel material may be effectively prevented.

Figure 2:
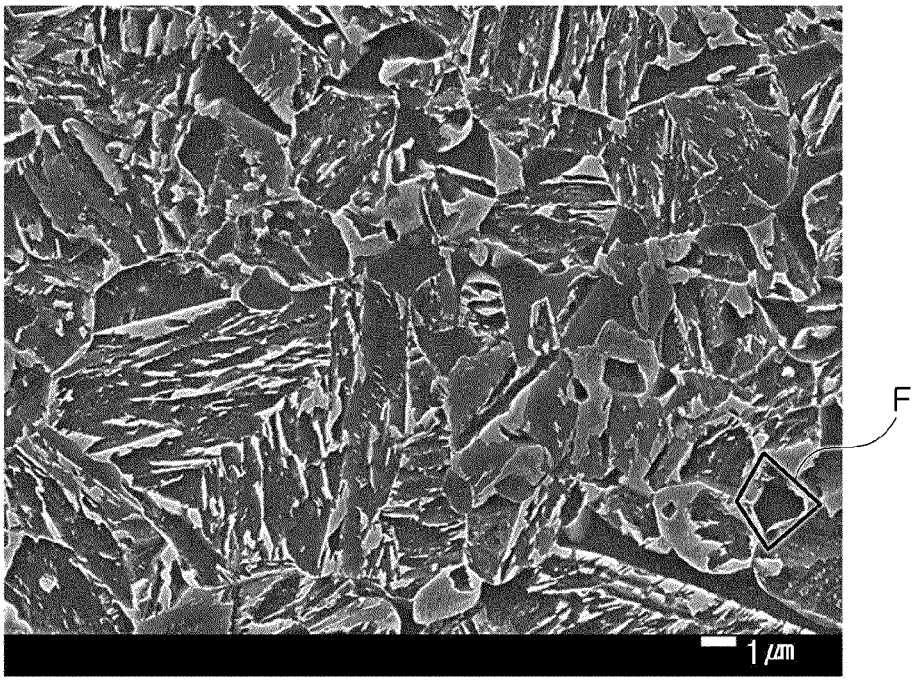
FIG. 2 is an image of a microstructure of a cold-rolled steel sheet observed using a scanning electron microscope according to an embodiment of the present disclosure.

FIG. 2 is an image of a microstructure of a cold-rolled steel sheet observed using a scanning electron microscope according to an embodiment of the present disclosure, and it is indicated that elongation and coarsening of ferrite (F) was effectively inhibited.

Also, in the case of general TRIP steel, since annealing heat treatment at a high temperature is performed after cold rolling, a decarburization phenomenon may occur on the surface of the steel material. Since carbon (C) may effectively contribute to stabilization of austenite, when decarburization occurs, the desired austenite stabilization effect may not be obtained on the surface of the steel material. In other words, as the austenite stabilization degree on the surface of the steel material decreases, it may not be possible to sufficiently secure a ratio of retained austenite ratio on the surface of the steel material.

Since retained austenite may be a structure which may effectively contribute to improvement of an elongation rate, an elongation rate of the surface layer of the steel material which does not sufficiently secure a desired ratio of retained austenite ratio may degrade. Therefore, when the retained austenite structure in the surface layer of the steel material is formed below a certain level, cracks may be easily generated from the surface side of the steel material during severe processing such as bending, such that fracture of the steel material may occur.

Therefore, according to an aspect of the present disclosure, by forming a nickel (Ni) concentration layer on the surface layer of the steel material, degradation of austenite stabilization caused by loss of carbon (C) in the surface layer of the steel material may be effectively prevented. In other words, since nickel (Ni) may contribute to stabilization of austenite at a similar level to that of carbon (C), even when carbon (C) is lost in the surface layer of the steel material during a high-temperature annealing heat treatment, degradation of austenite stabilization of the surface layer of the steel material may be effectively prevented by the nickel (Ni) concentration layer formed on the surface layer of the steel material.

The nickel (Ni) concentration layer in the present disclosure may be formed by nickel (Ni) powder applied to the surface of the steel material before annealing heat treatment after cold rolling. The present disclosure does not entirely exclude the formation of the nickel (Ni) concentration layer on the surface of the steel material by adding nickel (Ni) during steelmaking, but to form the nickel (Ni) concentration layer aimed in the present disclosure, a large amount of nickel (Ni) may need to be added, and thus, it may not be preferable in terms of economics, considering that nickel (Ni) is an expensive element. To form the nickel (Ni) concentration layer in the present disclosure, the nickel (Ni) powder may be applied in a coating amount of 300 $mg/m^2$ or more, and an upper limit of the coating amount of the nickel (Ni) powder may be limited to 2000 $mg/m^2$ in consideration of economic aspects.

Since the annealing heat treatment at a high temperature is performed after the nickel (Ni) powder is applied, the nickel (Ni) flowing into the steel material may form the nickel (Ni) concentration layer on the surface of the steel material. Accordingly, in the steel material in the present disclosure, the nickel (Ni) concentration at a depth of 1 μm from the surface of the steel material may be limited to a predetermined level. Since the steel material in the present disclosure may include the case in which a plating layer is formed on the surface, the nickel (Ni) concentration may be measured based on the nickel (Ni) concentration at a depth of 1 μm from the surface of the steel material. This is because the nickel (Ni) concentration layer may be formed on the surface side of the steel material, but components of the plating layer may flow into the portion directly under the surface of the steel material, such that it may be difficult to accurately measure the concentration of the nickel (Ni) concentration layer.

According to one preferable aspect of the present disclosure, the nickel (Ni) concentration at a depth of 1 μm from the steel surface may be controlled to be 0.15 wt % or more to secure a fraction of retained austenite on the surface side of the steel material to a desired level. Also, in terms of securing the fraction of retained austenite on the surface side of the steel material, the higher the nickel (Ni) concentration at a depth of 1 μm from the steel surface, the more advantageous it may be, but to this end, excessive nickel (Ni) powder may need to be coated and annealing heat treatment may need to be performed, which may not be desirable in terms of economic aspect. Accordingly, in the present disclosure, the nickel (Ni) concentration at a depth of 1 μm from the surface side of the steel material may be controlled to be 0.7 wt % or less, and more preferably, the nickel (Ni) concentration at a depth of 1 μm from the surface side of the steel material may be controlled to be 0.5 wt % or less.

In the present disclosure, since the nickel (Ni) concentration at a depth of 1 μm from the surface of the steel material is controlled to be a level of 0.15-0.7 wt %, the fraction of retained austenite observed on the surface of the steel material may be maintained at a level of 5-20 area %. Therefore, since the steel material in the present disclosure sufficiently secures an elongation rate at the surface layer side of the steel material, excellent bending workability may be secured.

When a cold bending test is performed on the steel material in the present disclosure, a critical curvature ratio (Rc/t) at the time at which a crack is created on the surface of the steel material may be 2 or less, and a more preferable critical curvature ratio (Rc/t) may be 1.5 or less. In the cold bending test in the present disclosure, a plurality of cold bending jigs having various radiuses of curvature (R) of tips may be applied, the 90° cold bending process may be performed on the steel material, and cracks in the surface layer of the steel material may be observed. The cold bending jig may be applied such that radiuses of curvature (R) of tips of the cold bending jig may sequentially decrease, and the critical curvature ratio (Rc/t) may be calculated based on a ratio between the radius of curvature (Rc) of the tip of the cold bending jig at the time at which cracks on the surface layer of the steel material and the thickness (t) of the steel sheet. The smaller the critical curvature ratio (Rc/t) is, the better resistance against crack generation may be secured even under severe bending conditions. Since the steel material in the present disclosure has a critical curvature ratio (Rc/t) of 2 or less, workability suitable for a steel material for vehicles may be obtained.

The cold-rolled steel sheet in the present disclosure satisfying the conditions may satisfy tensile strength of 1180 MPa or more and an elongation rate of 14% or more.

Hereinafter, the manufacturing method in the present disclosure will be described in greater detail.

Figure 3:
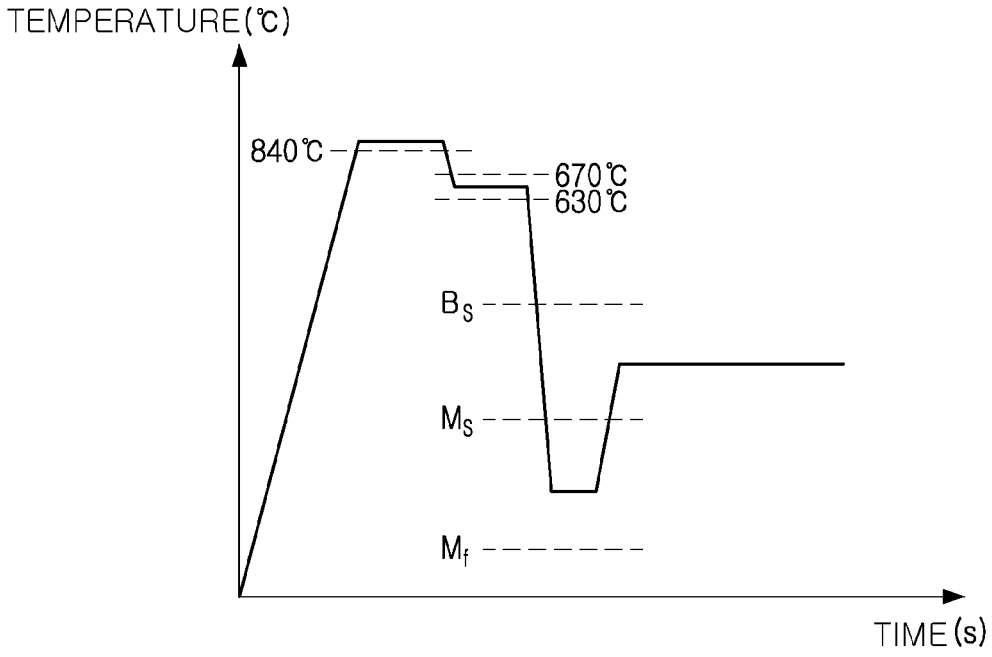
FIG. 3 is a graph indicating a manufacturing method of the present disclosure using changes in temperature over time.

The steel material having the composition described above may be cold-rolled, nickel (Ni) powder may be applied on a surface of the cold-rolled steel material in a coating amount of 300 mg/m$^2$, the steel material may be heated such that the steel material is completely transformed to austenite, the heated steel material may be slowly cooled at a cooling rate of 5-12° C./s to a slow cooling termination temperature of 630-670° C., the steel material may be maintained at the slow cooling termination temperature for 10-90 seconds, the slowly cooled and maintained steel material may be rapidly cooled at a cooling rate of 7-30° C./s to a temperature range of a martensitic transformation termination temperature (Mf) or higher and a martensitic transformation initiation temperature (Ms) or lower, the rapidly cooled steel material may be maintained at a temperature higher than the martensitic transformation initiation temperature (Ms) and the bainite transformation initiation temperature (Bs) or lower for 300-600 seconds and the steel material may be partitioned. FIG. 3 is a graph indicating a manufacturing method of the present disclosure after cold rolling and nickel (Ni) powder coating using changes in temperature over time.

The steel material provided for the cold rolling in the present disclosure may be a hot-rolled material, and the hot-rolled material may be a hot-rolled material used in the manufacturing of general TRIP steel. The method of manufacturing the hot-rolled material provided for cold rolling in the present disclosure is not particularly limited, and the slab having the composition described above may be reheated in a temperature range of 1000-1300° C., may be hot-rolled at a finish rolling temperature range of 800-950° C., and may be coiled in a temperature range of 750° C. or less. Cold rolling in the present disclosure may also be carried out under the process conditions performed in the manufacturing of general TRIP steel. Cold rolling may be performed at an appropriate reduction ratio to secure a thickness required by a customer, and it may be preferable to perform cold rolling at a cold reduction ratio of 30% or more to prevent generation of coarse ferrite in a subsequent annealing process.

Hereinafter, the process conditions in the present disclosure will be described in greater detail.

Applying Nickel (Ni) Powder after Cold Rolling

In the present disclosure, since a nickel (Ni) concentration layer needs to be formed on the surface layer of the steel material, nickel (Ni) may be supplied to the surface of the steel material after cold rolling. A method of supplying nickel (Ni) in the present disclosure is not particularly limited, and preferably, nickel (Ni) may be supplied to the surface of the steel material by a method of applying nickel (Ni) powder.

As described above, in the present disclosure, since the nickel (Ni) concentration at a depth of 1 μm from the surface of the steel material needs to be controlled to be 0.15 wt % or more, the nickel (Ni) powder may be applied in a coating amount of 300 mg/m$^2$ or more. Since nickel (Ni) is an expensive element, excessive coating may not be desirable economically. In the present disclosure, the coating amount of nickel (Ni) powder may be limited to 2000 mg/m$^2$ or less. A more preferable coating amount of nickel (Ni) powder may be in the range of 500-1000 mg/m$^2$.

Heating Steel in Austenitic Region

After cold rolling, a structure of the steel material coated with nickel (Ni) powder may be transformed into austenite, and the steel material may be heated to an austenite temperature range (full austenite region) to induce surface permeation of nickel (Ni).

Generally, in the case of TRIP steel including ferrite at a certain level, the steel material may be heated in an two-phase temperature range in which both austenite and ferrite are present, but when the steel material is heated as above, it may be difficult to obtain ferrite having an ratio between a particle size and a length intended in the present disclosure, and also, a band structure generated in the hot rolling process may remain as is such that it may be disadvantageous for addressing burring properties. Therefore, in the present disclosure, the cold-rolled steel material may be heated to an austenite region of 840° C. or higher.

Slow Cooling Heated Steel Material to Range of 630–670° C. and Maintaining Steel Material In the present disclosure, to micronize ferrite and to adjust a length ratio, the heated steel material may be slowly cooled at a cooling rate of 5-12° C./s and may be maintained for a certain period of time in the above temperature range. This is because ferrite having fine grains may be formed in the steel material by multiple nucleation actions during the slow cooling of the heated steel material. Accordingly, in the present disclosure, to increase a nucleation site of ferrite and to control the length ratio of ferrite, the heated steel may be slowly cooled to a certain temperature range. When the slow cooling is stopped after the slow cooling termination temperature is exceeded and rapid cooling is performed immediately, a sufficient ferrite fraction may not be secured such that it may be difficult to secure an elongation rate. When the slow cooling is performed to a temperature lower than the slow cooling termination temperature, a ratio of structures other than ferrite may be insufficient such that it may be difficult to secure strength. Thus, in the present disclosure, the slow cooling termination temperature may be limited to the range of 630-670° C. Also, since the slow cooling in the present disclosure applies a slightly higher cooling rate as compared to general slow cooling conditions, a ferrite nucleation site may effectively increase. Therefore, the cooling rate in the slow cooling in the present disclosure may be in the range of 5-12° C./s, and a more preferable cooling rate may be in the range of 7-12° C./s in terms of increasing the ferrite nucleation site.

After cooling the steel material to the temperature range of 630-670° C., the steel material slowly cooled in the above temperature may be maintained for 10-90 seconds. In the present disclosure, since the heated steel material is maintained after slow cooling, coarse growth of ferrite generated by the slow cooling may be effectively prevented. In other words, in the present disclosure, the growth of ferrite in a rolling direction may be effectively prevented by the slow cooling and maintaining, such that the length ratio (a length of the steel sheet in the rolling direction/a length of the steel sheet in the thickness direction) of ferrite may be effectively controlled.

Rapid Cooling the Slowly Cooled and Maintained Steel Material at Temperature of Mf-Ms To obtain martensite of an intended ratio in the present disclosure, a process of rapidly cooling the slowly cooled and maintained steel material to the temperature range of Mf-Ms may be followed. Here, "Mf" indicates a martensite transformation termination temperature, and "Ms" indicates a martensite transformation initiation temperature. Since the slowly cooled and maintained steel material is rapidly cooled to a temperature range of Mf-Ms, martensite and retained austenite may be introduced into the steel material after the rapid cooling. In other words, since the rapid-cooling termination temperature is controlled to be Ms or less, martensite may be introduced to the steel material after the rapid cooling, and since the rapid-cooling termination temperature is controlled to be Mf or higher, overall austenite may be prevented from being transformed into martensite, such that retained austenite may be introduced in the steel material after the rapid cooling. A preferable cooling rate in the rapid cooling may be in the range of 7-30° C./s, and one preferable means may be quenching.

Partitioning Treatment of Rapidly Cooled Steel

Since martensite in the rapidly cooled structure is formed by non-diffusion transformation of austenite including a large amount of carbon, a large amount of carbon may be included in martensite. In this case, hardness of the structure may be high, but toughness may be rapidly deteriorated, which may be problematic. Generally, a method of tempering a steel material at a high temperature to precipitate carbon as carbide in martensite may be used. However, in the present disclosure, a different method other than tempering may be used to control the structure by a unique method.

In other words, in the present disclosure, by maintaining the rapidly cooled steel material in a temperature range of higher than Ms and Bs or less for a certain period of time, carbon in martensite may be partitioned to retained austenite due to a difference in solid solution amount, and formation of a predetermined amount of bainite may be induced. Here, "Ms" indicates a martensite transformation initiation temperature, and "Bs" indicates a bainite transformation initiation temperature. When the carbon solid solution amount of retained austenite increases, stability of retained austenite may increase, such that a retained austenite fraction aimed in the present disclosure may be effectively secured.

Also, by maintaining the steel material as above, the steel material in the present disclosure may include bainite in an area ratio of 15-45%. That is, in the present disclosure, carbon may be partitioned between martensite and retained austenite in the primary cooling process and the secondary maintaining process after quenching, and a portion of martensite may be transformed into bainite, such that the intended structure according to an aspect of the present disclosure may be obtained.

To obtain a sufficient partitioning effect, the above-described maintaining time may be 300 seconds or more. When the holding time exceeds 600 seconds, it may be difficult to expect an increase of the effect, and productivity may be degraded, and thus, in an aspect of the present disclosure, an upper limit of the above-described maintaining time may be limited to 600 seconds.

The cold-rolled steel sheet having gone through the above-described treatment may be plated by a generally used method thereafter, and the plating treatment in the present disclosure may be an alloying hot-dip galvanizing treatment.

The cold-rolled steel sheet manufactured by the manufacturing method as above may include, by area fraction, 3-25% of ferrite, 20-40% of martensite, and 5-20% of retained austenite, and may include a nickel concentration layer, formed by nickel (Ni) introduced from the outside, on a surface layer, and a concentration of nickel (Ni) at a depth of 1 μm from a surface may be 0.15 wt % or more.

Also, the cold-rolled steel sheet manufactured by the manufacturing method as above may satisfy tensile strength of 1180 MPa or more, an elongation rate of 14% or more, and a critical curvature ratio (r/t) of 1.5 or less.

BEST MODE FOR INVENTION

Hereinafter, the present disclosure will be described in greater detail through examples. However, it should be noted that the following examples are only for exemplifying the present disclosure and not for limiting the scope of the present disclosure.

Embodiment

A cold-rolled steel sheet was manufactured by processing the steel material having a composition as in Table 1 below under conditions as in Table 2. In Table 2, rapid cooling was performed by spraying mist on the surface of the cold-rolled steel sheet or by spraying nitrogen gas or nitrogen-hydrogen mixed gas. In comparative example 1, maintaining after the rapid cooling was performed in a shorter time than the maintaining after the rapid cooling in the present disclosure, and in comparative example 3, the coating amount of nickel (Ni) was less than the range suggested in the present disclosure. The maintaining temperature after the rapid cooling satisfies the relationship of more than Ms and less than Bs in all inventive examples and comparative examples.

TABLE 1

| | Steel composition (wt %) | | | | | | | | | | |
|---|---|---|---|---|---|---|---|---|---|---|---|
| Classification | C | Si | Mn | P | S | Al | N | Cr | Mo | Ti | B |
| Inventive Example 1 | 0.23 | 1.8 | 2.4 | 0.02 | 0.003 | 0.03 | 0.006 | 0.3 | 0.01 | 0.02 | 0.002 |
| Inventive Example 2 | 0.2 | 1.7 | 2.6 | 0.006 | 0.005 | 0.21 | 0.004 | 0.01 | 0.03 | 0.02 | 0.002 |

TABLE 1-continued

| Classification | Steel composition (wt %) | | | | | | | | | | |
|---|---|---|---|---|---|---|---|---|---|---|---|
| | C | Si | Mn | P | S | Al | N | Cr | Mo | Ti | B |
| Inventive Example 3 | 0.16 | 1.1 | 2.8 | 0.011 | 0.006 | 0.047 | 0.005 | 0.03 | 0.02 | 0.02 | 0.002 |
| Inventive Example 4 | 0.19 | 1.5 | 2.2 | 0.01 | 0.004 | 0.03 | 0.006 | 0.02 | 0.04 | 0.02 | 0.002 |
| Inventive Example 5 | 0.18 | 1.7 | 2.5 | 0.015 | 0.005 | 0.05 | 0.005 | 0.5 | 0.02 | 0.02 | 0.002 |
| Comparative Example 1 | 0.22 | 1.2 | 2.5 | 0.008 | 0.005 | 0.39 | 0.006 | 0.05 | 0.05 | 0.02 | 0.002 |
| Comparative Example 2 | 0.27 | 0.1 | 1.1 | 0.015 | 0.008 | 0.043 | 0.005 | 0.002 | 0.01 | 0.02 | 0.002 |
| Comparative Example 3 | 0.2 | 1.6 | 2.7 | 0.01 | 0.007 | 0.03 | 0.004 | 0.1 | 0.02 | 0.02 | 0.002 |

TABLE 2

| Classification | Ni Power coating amount (mg/m$^2$) | Heating temperature (° C.) | Heating time (seconds) | Slow cooling termination temperature (° C.) | Slow cooling rate (° C./s) | Maintaining time after slow cooling (seconds) | Rapid cooling termination temperature (° C.) | Maintaining temperature after rapid cooling (° C.) | Maintaining time after rapid cooling (seconds) | Whether plating performed |
|---|---|---|---|---|---|---|---|---|---|---|
| Inventive Example 1 | 700 | 870 | 60 | 650 | 25 | 60 | 300 | 400 | 500 | Performed |
| Inventive Example 2 | 500 | 870 | 60 | 650 | 25 | 60 | 300 | 400 | 500 | Performed |
| Inventive Example 3 | 900 | 850 | 60 | 650 | 25 | 60 | 300 | 400 | 500 | Performed |
| Inventive Example 4 | 600 | 870 | 60 | 650 | 25 | 60 | 300 | 400 | 500 | Performed |
| Inventive Example 5 | 800 | 870 | 60 | 650 | 25 | 60 | 300 | 400 | 500 | Performed |
| Comparative Example 1 | 500 | 870 | 60 | 650 | 25 | 60 | 300 | 400 | 100 | Performed |
| Comparative Example 2 | 700 | 870 | 60 | 650 | 25 | 60 | 300 | 400 | 500 | Performed |
| Comparative Example 3 | 10 | 870 | 60 | 650 | 25 | 60 | 300 | 400 | 500 | Performed |

Results of evaluating an internal structure and physical properties of the cold-rolled steel sheet manufactured by the above-described process are listed in Table 3 below. A microstructure of each cold-rolled steel sheet was observed and evaluated using a scanning electron microscope. The nickel (Ni) concentration was analyzed and evaluated based on a result of energy dispersive X-ray analysis of the scanning electron microscope, and the nickel (Ni) concentration was measured after removing the plating layer using hydrochloric acid to ensure accuracy of the measurement result. Yield strength (YS), tensile strength (TS) and an elongation rate (T-El) were measured and evaluated using a JIS No. 5 tensile strength test sample. The evaluation of plating properties was determined based on whether an unplated region is present on the surface (X) or not (O).

TABLE 3

| Classification | Ni concentration at depth of 1 μm from surface | Ratio of ferrite (area %) | Ratio of marten site (area %) | Ratio of retained austenite (area %) | Ratio of bainite (area %) | Yeild strength (MPa) | Tensile strength (MPa) | Elongation rate (%) | Critical curvature ratio (r/t) | Plating properties |
|---|---|---|---|---|---|---|---|---|---|---|
| Inventive Example 1 | 0.3 | 9 | 29 | 13 | 49 | 1045 | 1270 | 18 | 0.5 | 0 |
| Inventive Example 2 | 0.2 | 13 | 32 | 11 | 44 | 1021 | 1258 | 16 | 0.5 | 0 |
| Inventive Example 3 | 0.45 | 14 | 30 | 10 | 46 | 968 | 1202 | 15 | 1 | 0 |
| Inventive Example 4 | 0.26 | 22 | 31 | 12 | 35 | 905 | 1245 | 16 | 1.7 | 0 |
| Inventive Example 5 | 0.38 | 20 | 34 | 11 | 35 | 921 | 1278 | 15 | 1.7 | 0 |
| Comparative Example 1 | 0.2 | 15 | 39 | 4 | 42 | 873 | 1351 | 9 | 2 | 0 |

TABLE 3-continued

| Classification | Ni concentration at depth of 1 μm from surface | Ratio of ferrite (area %) | Ratio of marten site (area %) | Ratio of retained austenite (area %) | Ratio of bainite (area %) | Yeild strength (MPa) | Tensile strength (MPa) | Elongation rate (%) | Critical curvature ratio (r/t) | Plating properties |
|---|---|---|---|---|---|---|---|---|---|---|
| Comparative Example 2 | 0.3 | 7 | 41 | 3 | 49 | 1120 | 1398 | 8 | 2 | 0 |
| Comparative Example 3 | 0.01 | 11 | 27 | 12 | 50 | 1002 | 1240 | 16 | 3 | 0 |

As indicated in Table 3, as for inventive examples 1 to 5 satisfying the composition of the present disclosure and satisfying the manufacturing conditions of the present disclosure, a nickel (Ni) concentration at a depth of 1 μm from the surface of base iron was 0.15 wt % or more, and it is indicated that a critical curvature ratio (r/t) was 2 or less.

Figure 4:
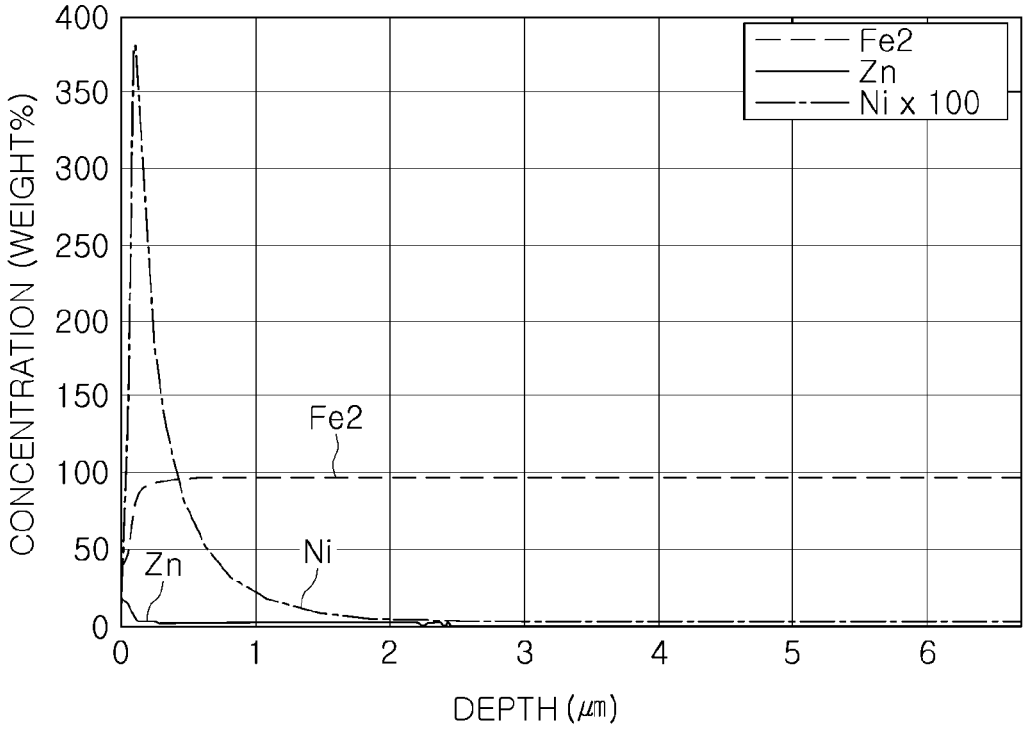
FIG. 4 is a result of analysis of a concentration of each composition element in a depth direction of inventive example 2 using GDS.

FIG. 4 is a result of analysis of a concentration of each composition element in a depth direction of inventive example 2 using GDS. In FIG. 4, the x-axis refers to a depth (μm) from the surface of the steel sheet, and the y-axis refers to the concentration (wt %) of the corresponding element. To accurately measure the Ni concentration, the ×100 scale was applied to the Ni concentration. In other words, the numerical range of 100 on the y-axis refers to 100 wt % as for Fe and Zn, but refers to 1 wt % as for Ni. As indicated in FIG. 4, in inventive example 2, a nickel (Ni) concentration layer was formed on the surface of the steel sheet, and the nickel (Ni) concentration at a depth of 1 μm from the surface of the steel sheet was 0.2 wt %, and thus, the bending workability aimed in the present disclosure was secured.

As for comparative examples 1 to 3 which do not satisfy the steel composition of the present disclosure and/or the manufacturing conditions of the present disclosure, an elongation rate and/or bending workability aimed in the present disclosure were not secured.

As for comparative example 1, the partitioning was performed in a shorter time than the partitioning time limited in the present disclosure, and the retained austenite was not sufficiently formed, such that an elongation rate and bending workability degraded.

As for comparative example 2, since the C content exceeded the range in the present disclosure, and Si and Mn did not reach the range in the present disclosure, the retained austenite was not sufficiently formed such that an elongation rate and bending workability degraded.

Since comparative example 3 does not satisfy the Ni concentration condition limited in the present disclosure, bending workability degraded. It is assumed that such deterioration in bending workability was caused by insufficient formation of retained austenite in the surface layer of the steel sheet due to the decarburization phenomenon.

Therefore, the invention example satisfying both the steel composition and manufacturing conditions in the present disclosure satisfies an elongation rate and a critical curvature ratio (Rc/t) aimed in the present disclosure, whereas the comparative example which does not satisfy one or more of the steel composition and manufacturing conditions of the present disclosure does not satisfy one or more physical properties values of an elongation rate and a critical curvature ratio (Rc/t) intended in the present disclosure.

While the example embodiments have been illustrated and described above, it will be apparent to those skilled in the art that modifications and variations could be made without departing from the scope of the present disclosure as defined by the appended claims.

The invention claimed is:

1. A cold-rolled steel sheet comprising:

by weight %, 0.13-0.25% of carbon (C), 1.0-2.0% of silicon (Si), 1.5-3.0% of manganese (Mn), 0.08-1.5% of aluminum (Al)+chromium (Cr)+molybdenum (Mo), 0.1% or less of phosphorus (P), 0.01% or less of sulfur (S), 0.01% or less of nitrogen (N), and a balance of Fe and inevitable impurities;

by area fraction, 3-25% of ferrite, 20-40% of martensite, and 5-20% of retained austenite; and a nickel concentration layer, formed by nickel (Ni) introduced from outside, as a surface layer, wherein a concentration of nickel (Ni) at a depth of 1 μm from a surface is 0.15 wt % or more.

2. The cold-rolled steel sheet of claim 1, wherein a critical curvature ratio (Rc/t) of the cold-rolled steel sheet is 2 or less, where the critical curvature ratio (Rc/t) is measured by a cold bending test in which a steel sheet is bent by 90° using a plurality of cold bending jigs having tips of various radiuses of curvature (R), and t and Rc refer to a thickness of the steel sheet provided to the cold bending test and a radius of curvature of a tip of a cold bending jig at the time at which cracks are created in the surface layer of the steel sheet, respectively.

3. The cold-rolled steel sheet of claim 1, further comprising: 15 to 50% of bainite by area fraction.

4. The cold-rolled steel sheet of claim 1, wherein a fraction of the retained austenite is 5 to 20 area % on the surface of the cold-rolled steel sheet.

5. The cold-rolled steel sheet of claim 1, wherein, based on t/4, where t refers to a thickness of the steel sheet, an average grain size of the ferrite is 2 μm or less, and an average value of a ratio of a length of the ferrite in a rolling direction to a length of the ferrite in a thickness direction is 0.5-1.5.

6. The cold-rolled steel sheet of claim 1, wherein the area fraction of the ferrite is 3-15%.

7. The cold-rolled steel sheet of claim 1, wherein the martensite includes tempered martensite and fresh martensite, and wherein a ratio of the tempered martensite in the martensite exceeds 50 area %.

8. The cold-rolled steel sheet of claim 1, further comprising:

by weight %, one or more of 0.001-0.005% of boron (B) and 0.005-0.04% of titanium (Ti).

9. The cold-rolled steel sheet of claim 1, wherein the aluminum (Al) is included in an amount of 0.01-0.09 weight %.

10. The cold-rolled steel sheet of claim 1, wherein the chromium (Cr) is included in an amount of 0.01-0.7 weight %.

11. The cold-rolled steel sheet of claim 1, wherein the molybdenum (Mo) is included in an amount of 0.02-0.08 weight %.

12. The cold-rolled steel sheet of claim 1, further comprising:

an alloyed hot-dip galvanized layer formed on the surface thereof.

13. The cold-rolled steel sheet of claim 1, wherein the cold-rolled steel sheet has a tensile strength of 1180 MPa or more and an elongation rate of 14% or more.

* * * * *